US008657618B2

(12) United States Patent
Beuster et al.

(10) Patent No.: US 8,657,618 B2
(45) Date of Patent: Feb. 25, 2014

(54) HIGH-VOLTAGE CONNECTOR COMPONENT FOR A HIGH-VOLTAGE CABLE, HIGH-VOLTAGE CONNECTOR, AND METHOD OF MANUFACTURING A HIGH-VOLTAGE CONNECTOR COMPONENT

(75) Inventors: Bernd Beuster, Ahrensburg (DE); Michael Schaefer, Ahrensburg (DE)

(73) Assignee: GE Sensing and Inspection Technologies GmbH, Huerth (DE)

( * ) Notice: Subject to any disclaimer, the term of this patent is extended or adjusted under 35 U.S.C. 154(b) by 24 days.

(21) Appl. No.: 13/372,607

(22) Filed: Feb. 14, 2012

(65) Prior Publication Data

US 2012/0208386 A1 Aug. 16, 2012

(30) Foreign Application Priority Data

Feb. 15, 2011 (EP) ..... 11001204

(51) Int. Cl.
*H01R 13/52* (2006.01)

(52) U.S. Cl.
USPC ..... 439/283

(58) Field of Classification Search
USPC ..... 439/281, 283, 271, 273, 628, 322, 204, 439/683; 264/272.11; 174/77 R, 74 C
See application file for complete search history.

(56) References Cited

U.S. PATENT DOCUMENTS

| | | | | |
|---|---|---|---|---|
| 3,323,097 | A | 5/1967 | Tordoff | |
| 3,816,641 | A * | 6/1974 | Iversen | 174/76 |
| 3,904,264 | A * | 9/1975 | Oertle | 439/273 |
| 4,296,986 | A * | 10/1981 | Herrmann, Jr. | 439/322 |
| 4,886,471 | A | 12/1989 | Fleshman, Jr. | |
| 5,354,221 | A * | 10/1994 | Doherty et al. | 439/683 |
| 5,358,419 | A | 10/1994 | Pejsa et al. | |
| 5,580,266 | A * | 12/1996 | Shelly | 439/281 |
| 5,626,486 | A * | 5/1997 | Shelly et al. | 439/281 |
| 6,641,421 | B1 * | 11/2003 | Leavitt et al. | 439/271 |
| 6,781,060 | B2 * | 8/2004 | Radley | 174/84 R |
| 6,991,484 | B2 * | 1/2006 | Luzzi | 439/181 |
| 7,150,562 | B2 * | 12/2006 | Hansen et al. | 378/204 |
| 7,331,806 | B2 * | 2/2008 | Stagi et al. | 439/204 |

(Continued)

FOREIGN PATENT DOCUMENTS

| | | |
|---|---|---|
| DE | 697 23 720 T2 | 4/2004 |
| EP | 0 487 025 A1 | 5/1992 |

(Continued)

*Primary Examiner* — Alexander Gilman
(74) *Attorney, Agent, or Firm* — Lazaris IP

(57) ABSTRACT

A high-voltage connector component for a high-voltage cable comprises an insulator made of a polymer material which surrounds a cable end portion of the high-voltage cable, wherein the insulator is received in a housing and is made of an elastomer material, wherein the elastomer material is filled, cast or injected into the housing in order to form the insulator. The connector component is designed such that upon connection to a corresponding connector component a basically closed pressure chamber is formed between the housing, the corresponding connector component and the cable end portion, wherein the pressure chamber is basically provided for being completely occupied by the insulator. Loading the insulator with pressure results in a gap-free, high-voltage-sealed pressing of the corresponding connector component to the insulator, a gap-free, high-voltage-sealed pressing of the insulator to the housing, and a gap-free, high-voltage-sealed pressing of the insulator to the sheath surface of the cable end portion.

18 Claims, 1 Drawing Sheet

(56) References Cited

U.S. PATENT DOCUMENTS

| | | | | |
|---|---|---|---|---|
| 7,601,014 | B2 * | 10/2009 | Wandler | 439/181 |
| 2007/0190854 | A1 * | 8/2007 | Harwath | 439/578 |
| 2011/0025342 | A1 * | 2/2011 | Siebens | 324/538 |
| 2012/0208386 | A1 * | 8/2012 | Beuster et al. | 439/283 |

FOREIGN PATENT DOCUMENTS

| | | | |
|---|---|---|---|
| EP | 0487025 | B1 | 4/1995 |
| EP | 0 938 759 | | 7/2003 |
| WO | WO 98/21786 | A1 | 5/1998 |

* cited by examiner

HIGH-VOLTAGE CONNECTOR COMPONENT FOR A HIGH-VOLTAGE CABLE, HIGH-VOLTAGE CONNECTOR, AND METHOD OF MANUFACTURING A HIGH-VOLTAGE CONNECTOR COMPONENT

CROSS REFERENCE TO RELATED PATENT APPLICATIONS

To the fullest extent permitted by law, this nonprovisional utility patent application claims priority under 35 U.S.C. §119 to European Patent Office Patent Application No. 11 001 204.4, filed Feb. 15, 2011.

STATEMENT REGARDING FEDERALLY-SPONSORED RESEARCH OR DEVELOPMENT

Not applicable.

FIELD OF THE INVENTION

The invention relates to a high-voltage connector component for a high-voltage cable comprising an insulator made of a polymer material which surrounds a cable end portion of the high-voltage cable, a high-voltage connector, and a method of manufacturing a high-voltage connector component.

BACKGROUND OF THE INVENTION

A known rubber cone plug connector includes a cone-shaped rubber body tapering towards the contact side which, for establishing a high-voltage connection, is inserted into the socket until a front side of the rubber body abuts against an edge of the socket. The rubber body first needs to be adjusted exactly in order that a defined pressure gets the cone to abut. For manufacturing the rubber body the cable end portion is partially stripped, machined by metal-cutting, then caoutchouc rubber is wound around the cable end portion and is vulcanized to the same; however, this method is very time-consuming and costly. For the assembly the rubber cone further needs to be greased before the plug connector is inserted into the socket, in order to obtain a reliable high-voltage seal between the rubber cone and the receptacle. However, the grease evaporates over time, is absorbed by the rubber or age-hardens; furthermore, the cable material slackens due to aging. A regular time-consuming maintenance is thus required for maintaining a reliable high-voltage seal, with the need to remove the old grease and to apply new grease and to check the adjustment and, if necessary, perform a re-adjustment.

Different rubber cone plug connectors are also known in which the high-voltage conductors are embedded directly into the rubber cone, see for example U.S. Pat. No. 5,358,419 and EP 0 938 759 B1, and thus the rubber cone does not enclose a cable end portion. The manufacture of these rubber cone plug connectors is time-consuming and costly.

Furthermore, a high-voltage plug connector comprising an insulator made of a casting resin is known, in which the insulator is manufactured using vacuum high-temperature casting in a casting mould, machined, coated, pasted into the plug connector housing and bonded and potted to the machined cable end portion in a non-porous and gap-free manner. The thermosetting insulator can no longer be removed out of the plug connector housing or from the cable end portion for repair purposes or maintenance purposes. In order to guarantee a gap-free abutment to the socket, additional measures need to be taken between the insulator and the socket for obtaining a sufficient high-voltage seal. This high-voltage plug connector neither requires maintenance nor adjustment, but is very cost-intensive, susceptible to damage and it cannot be repaired.

U.S. Pat. No. 5,626,486 A discloses a high voltage electrical connector assembly having a first connector with socket terminals matable with a second connector having pin terminals. The socket terminals are disposed in respectively gradually tapered silos of elastomeric material, and the second connector is formed of rigid dielectric material to include silo-receiving recesses surrounding the pin contact sections of the pin terminals. Upon completion of connector mating, the silos are longitudinally compressed at leading end portions, and thereby become radially expanded to tightly engage inner surfaces of the silo-receiving recesses and establish compression seals to define sealing of the mating interface against voltage leakage paths that otherwise would permit generation of corona.

U.S. Pat. No. 3,323,097 discloses a termination for a high-voltage shielded cable, comprising a pre-fabricated, metallic dielectric stress relief member of frustoconical shape and an insulating member of frustoconical shape complementary to the stress relief member. Tightening of a collar compresses the frustoconical insulating member against the cable insulation to hermetically seal the cable termination.

EP 0 487 025 A1 and U.S. Pat. No. 4,886,471 disclose related high-voltage connectors.

It is the object of the invention to provide a maintenance-free connector component ensuring a permanent safe high-voltage connection, a high-voltage connector, and a method of manufacturing the same, where the manufacturing, maintenance and repair effort are significantly reduced.

BRIEF SUMMARY OF THE INVENTION

The invention solves this object with the features of the independent claims. Owing to the insulator being made of an elastomer material, an additional sealing element between the connector components, like for example a rubber disc, can be dispensed with. According to the invention a pressure chamber is formed between the plug connector housing, the corresponding connector component and the cable end portion when the connector components are connected, which is basically completely occupied by the insulator. As the elastomer advantageously behaves like a fluid under pressure, a force exerted to the insulator in particular in the connecting direction results in a gap-free, high-voltage-sealed pressing of the corresponding connector component to the insulator and a gap-free, high-voltage-sealed pressing of the insulator to the sheath surface of the cable end portion, and preferably also to the housing. As a result, an excellent high-voltage seal is obtained without further measures between the connector components, the insulator, the cable end portion and the housing. The formerly performed greasing of the insulator and the significant maintenance effort associated therewith can be omitted as well as for example bonding the insulator to the cable end portion. A slackening of the cable due to aging, and a detachment of the insulator from the cable end portion or the housing, can be compensated without further measures.

The term elastomer material also includes materials which are elastic in certain temperature ranges only, in particular thermoplastic elastomers, and materials showing a mostly elastomeric and not mostly plastic behavior.

In a particularly advantageous embodiment the insulator is filled, cast or injection-molded into the housing, as a result of which the manufacturing steps known from prior art and the corresponding time effort can be reduced significantly. For this purpose a filler inlet is preferably provided in the housing for casting in, filling in or injecting elastomer material for the insulator.

It is advantageous for the pressure transmission if the elastomer material of the insulator shows a high level of incompressibility. Particularly preferred materials are therefore rubber or silicone elastomer. The latter provides the advantage that it can be worked with little effort and short manufacturing periods using open low temperature casting.

BRIEF DESCRIPTION OF THE SEVERAL VIEWS OF THE DRAWINGS

In the following, the invention is described in more detail on the basis of preferred embodiments with reference to the accompanying figures. The figures show.

DETAILED DESCRIPTION OF THE INVENTION

Figure 1:
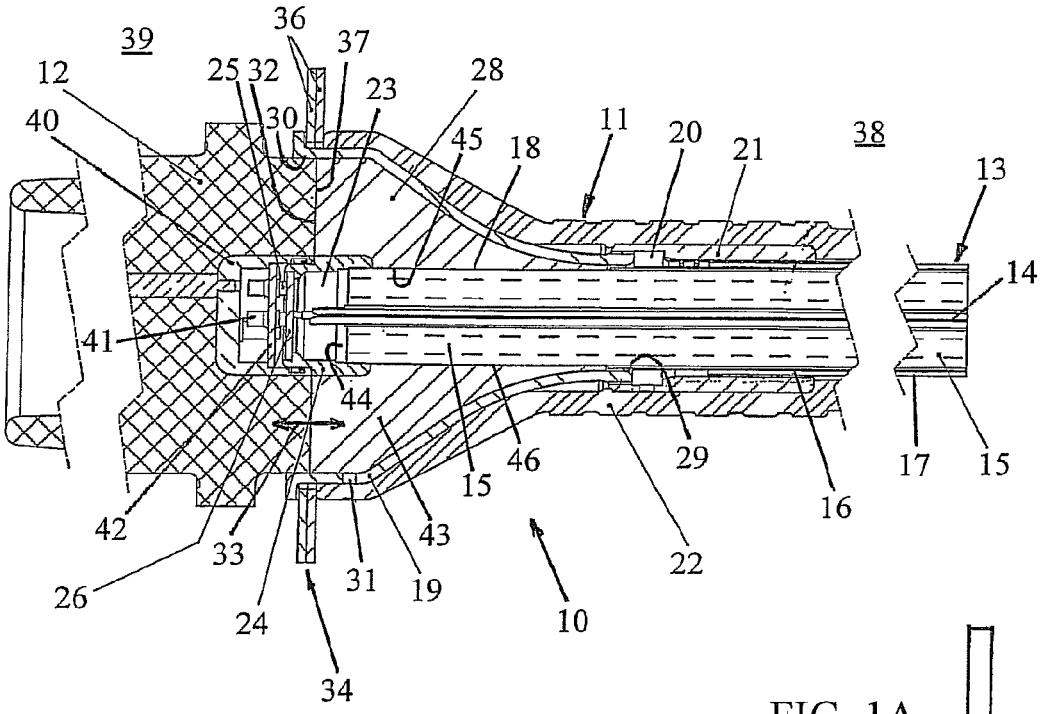
FIG. 1 is a cross-sectional view of a high-voltage connector.

The high-voltage connector 10 includes a high-voltage plug connector 11 and a corresponding socket 12. The connector 10 in particular serves to supply an x-ray component, for example an x-ray tube, with high voltage in particular in the range of 60 kV up to 500 kV. The socket 12 is preferably fixed relative to the housing, for example fixed to the housing of a high-voltage generator.

The plug connector 11 is expediently connected to a high-voltage cable 13 which generally comprises high-voltage conductors 14, a tube-shaped insulating layer 15 for high-voltage insulation of the conductors 14 to the outside, a conducting layer 16 for shielding and a protective sheathing 17. In the region of the plug connector 11 the sheathing 17 and the shielding 16 are removed. This partially stripped cable portion which still comprises the tube-shaped insulating layer 15 is referred to as cable end portion 18.

The plug connector 11 comprises a housing 19 which preferably is electrically conductive and preferably is made of metal, for example steel sheet. A conductive plastic material would also be possible. The housing 19 is connected to the cable shielding 16 in a conductive manner in order to guarantee a continuous shielding, in particular using a connecting device 20. The connecting region between plug connector 11 and cable 13 is supported using a strain relief 21. The whole plug connector 11 including housing 19 and strain relief 21 is enclosed by a bend protection 22 made of a suitable material.

Figure 2:
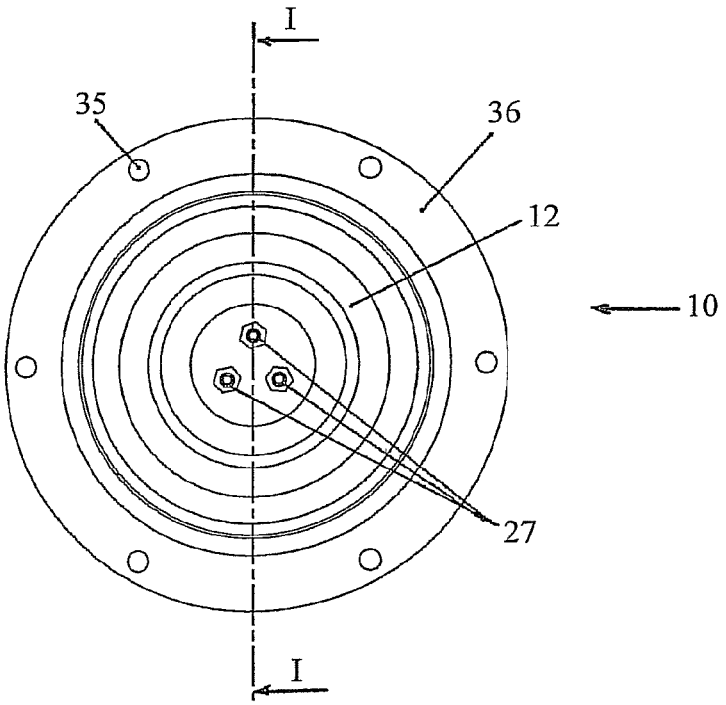
FIG. 2 is an axial view of the high-voltage connector from FIG. 1.

A contact housing 24 is preferably provided in the plug connector housing 19. In the contact housing 24 plug contacts 25 for the high-voltage conductors 14 of the plug connector 11 and, where applicable, a contact circuit board 26 are located. The socket 12 comprises a corresponding contact housing 40 in which corresponding plug contacts 41 and, where applicable, a contact circuit board 42 are located. The contact housings 24, 40 are preferably designed to be insertable into each other, as shown in FIG. 1, and thus form a conjoint contact chamber 23. FIG. 2 shows socket-side connection terminals 27 for the high-voltage conductors 14.

An insulator 28 is located in the chamber between the plug connector housing 19 and the cable end portion 18. The insulator 28 is made of a preferably low or room temperature cured elastomer material, for example silicone elastomer or rubber. The cable end portion 18 extends through the whole insulator 28 and is mounted in the contact housing 24 preferably at its front side 44, as is shown in FIG. 1. The insulator 28 circumferentially encloses the cable end portion 18 at its sheath surface 46, in particular in an annular manner, and forms a traversing axial opening 45 for the cable end portion 18.

The insulator 28 preferably rests against the inner surface of the housing 19 in a close fitting manner. The housing 19 is funneled and preferably tapers towards the cable side 38 for field control purposes. The insulator 28 is preferably incorporated completely in the housing 19, i.e. the insulator 28 preferably does not comprise any part projecting from the housing 19. However, it is not excluded that the insulator 28 projects from the housing, for example if the contact surface 32 of the insulator 28 is frustoconical. For repair purposes the elastomer material of the insulator 28 can be removed out of the housing 19 with relatively little effort.

For manufacturing the plug connector 11, the cable 13 or the cable end portion 18 is inserted through an opening 29 pro-vided in the housing 19 on the cable side 38 of the plug connector 11, where the inner diameter of the opening 29 is adapted to the outer diameter of the cable end portion 18.

Figure 1A:
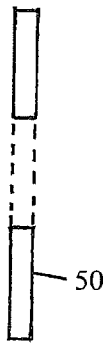
FIG. 1*a* is schematic cross-sectional view of a cover lid.

Afterwards the opening 30 located in the housing 19 on the contact side 39 of the plug connector 11 is closed with a cover lid 50 schematically shown in FIG. 1*a*. The cover lid 50 may for example be an annular disc with a central opening through which the contact housing 24 extends, or may have any other suitable form. It may be made of metal, plastic or any other suitable material. The preferably low temperature curing silicone caoutchouc is then filled into the closed chamber 43 through a filler inlet 31 provided in the housing 19. The filling chamber 43 is limited by the housing 19, the cable end portion 18, the contact housing 24 and the cover lid 50. Due to the planar inner surface of the cover lid 50, a planar contact surface 32 of the insulator 28 is thus formed, which is oriented perpendicular to the connecting direction 33 of the connectors 10 which is illustrated in FIG. 1 by a double arrow.

A preferably annular pressure-loading means 34 enclosing the contact-side opening 30 is provided at the outer surface of the plug connector housing 19 for loading the insulator 28 with pressure when the connector components 11, 12 are connected. The pressure-loading means 34 preferably consists of one or more, in the present case two, disc springs 36 comprising circumferentially distributed bores 35 for fastening means not shown in the Figures, for example screws.

For assembling the connectors 10, the plug connector 11 is first inserted into the socket 12 along the connecting direction 33, with the contact pins 25 of the plug connector 11 and of the socket 12 engaging each other in order to establish the high-voltage connection. When the connectors 10 are assembled the planar contact surface 32 of the insulator 28 rests against a corresponding planar contact surface 37 of the socket 12, which expediently is also oriented perpendicular to the connecting direction 33. The surface 37 of the socket 12, the housing 19, the sheath surface 46 of the cable end portion 18 and the contact housing 24 form a basically closed (apart from functional openings like for example the filler inlet 31) pressure chamber 43.

The disc springs 36 are then pulled against the socket 12 using the fastening screws engaging through the openings 35 until the disc springs 36 are located in a vertical position, as shown in FIG. 1, and thus indicate that a predetermined high fastening force in the range of for example 10 kN has been reached. The fastening force is transmitted from the contact surface 37 of the socket 12 to the contact surface 32 of the insulator 28. Due to the high pressure exerted on the insulator 28 by the pressure-loading device 34 and due to the elasticity of the insulator 28 an excellent high-voltage seal is obtained between the plug connector 11 and the socket 12. It is no longer required to insert a separate rubber seal disc and to apply grease between the connector components 11, 12.

Regular maintenance of the connectors 10 may thus be omitted.

Owing to the fluid-like behavior of the insulator 28 under pressure load and due to the closed pressure chamber 43, a pressure exerted by the contact surface 37 of the socket 12 onto the contact surface 32 of the insulator 28 is transmitted by the insulator and results in the insulator 28 being pressed to the whole sheath surface 46 of the cable end portion 18 contacting the insulator 28, and to the whole inner surface of the housing 19 contacting the insulator 28, so that between the insulator 28 and the cable end portion 18 as well as between the insulator 28 and the housing 19 an excellent high-voltage seal is obtained. Even a slackening of the cable end portion 18 due to aging is compensated. The housing 19 is adapted to absorb the forces exerted by the pressure-loading device 34.

In other embodiments not shown, the connector 10 may of course be designed vice-versa comprising a panel plug 12 and a plug-in coupling or receptacle 11.

The invention claimed is:

1. A high-voltage connector component for a high-voltage cable comprising an insulator made of a polymer material which surrounds a cable end portion of the high-voltage cable, wherein the insulator is received in a housing of the high-voltage connector component and is made of an elastomer material, wherein the elastomer material is filled, cast or injected into the housing in order to form the insulator, and the housing has an opening provided on its contact side, wherein the insulator has a contact surface in the area of this opening that rests against a contact surface of a corresponding connector element when the high-voltage connector component is connected to a corresponding connector element so that upon connection to said corresponding connector component a basically closed pressure chamber is formed between the housing, the corresponding connector component and the cable end portion, wherein the pressure chamber is provided for being basically completely occupied by the insulator, such that loading the insulator with pressure via its contact surface results in a gap-free, high-voltage-sealed pressing of the corresponding connector component to the insulator, a gap-free, high-voltage-sealed pressing of the insulator to the housing, and a gap-free, high-voltage-sealed pressing of the insulator to the sheath surface of the cable end portion.

2. The high-voltage connector component according to claim 1, wherein the elastomer material of the insulator is made of a low temperature castable caoutchouc material.

3. The high-voltage connector component according to claim 1, wherein the elastomer material of the insulator is made of a high temperature castable or injection-moldable caoutchouc material.

4. The high-voltage connector component according to claim 1, wherein the cable end portion still comprises a tube-shaped high-voltage insulation of the high-voltage cable.

5. The high-voltage connector component according to claim 1, wherein the insulator rests against the housing in a close fitting manner.

6. The high-voltage connector component according to claim 1, wherein a filler inlet is provided in the housing for injecting or filling in the elastomer material for forming the insulator.

7. The high-voltage connector component according to claim 1, including a pressure-loading means for loading the insulator with pressure when the connector components are connected.

8. The high-voltage connector component according to claim 7, wherein the pressure-loading means includes at least one disc spring.

9. The high-voltage connector component according to claim 1, wherein the insulator is incorporated completely within the housing.

10. The high-voltage connector component according to claim 1, wherein the insulator is basically made of rubber.

11. The high-voltage connector component according to claim 1, wherein the insulator is basically made of silicone elastomer.

12. A high-voltage connector comprising a first connector component for a high-voltage cable and a second connector component co-operating with said first connector component, said first connector component comprising an insulator made of a polymer material which surrounds a cable end portion of the high-voltage cable, wherein the insulator is received in a housing of the first connector component and is made of an elastomer material, wherein the elastomer material is filled, cast or injected into the housing in order to form the insulator, and the housing has an opening provided on its contact side, wherein the insulator has a contact surface in the area of this opening that rests against a contact surface of the second connector element so that upon connection to the second connector component a basically closed pressure chamber is formed between the housing, the second connector component and the cable end portion, wherein the pressure chamber is provided for being basically completely occupied by the insulator, such that loading the insulator with pressure via its contact surface results in a gap-free, high-voltage-sealed pressing of the second connector component to the insulator, a gap-free, high-voltage-sealed pressing of the insulator to the housing, and a gap-free, high-voltage-sealed pressing of the insulator to the sheath surface of the cable end portion, wherein, when the connector components are connected in a high-voltage insulating manner, the insulator of the first connector component directly, without a separate intermediate part, rests under pressure load against a counter surface of the second connector component.

13. The high-voltage connector according to claim 12, wherein the cable end portion still comprises a tube-shaped high-voltage insulation of the high-voltage cable.

14. The high-voltage connector according to claim 12, wherein the insulator rests against the housing in a close fitting manner.

15. The high-voltage connector according to claim 12, wherein a filler inlet is provided in the housing for injecting or filling in the elastomer material for forming the insulator.

16. The high-voltage connector according to claim 12, including a pressure-loading means for loading the insulator with pressure when the connector components are connected.

17. The high-voltage connector according to claim 16, wherein the pressure-loading means includes at least one disc spring.

18. The high-voltage connector according to claim 12, wherein the insulator is incorporated completely within the housing.

* * * * *